US005442882A

United States Patent [19]

Repasky

[11] Patent Number: 5,442,882

[45] Date of Patent: Aug. 22, 1995

[54] UNIVERSAL SLOPE COMPENSATOR FOR USE IN CONSTRUCTING A FLAT SURFACE

[76] Inventor: John Repasky, 140 Bender Rd., Hanover, Pa. 17331

[21] Appl. No.: 230,497

[22] Filed: Apr. 20, 1994

[51] Int. Cl.[6] ..... E04B 5/00

[52] U.S. Cl. ..... 52/105; 52/126.6; 52/263; 248/188.4; 248/650

[58] Field of Search ..... 52/105, 126.5, 126.6, 52/263, 677, 678; 248/354 R, 188.4, 650, 623

[56] References Cited

U.S. PATENT DOCUMENTS

| | | | |
|---|---|---|---|
| 875,775 | 1/1908 | Burhorn | 52/126.5 |
| 1,755,708 | 4/1930 | Symons . | |
| 2,723,100 | 11/1955 | Muschamp et al. . | |
| 3,223,415 | 6/1962 | Stengel et al. . | |
| 3,308,587 | 12/1963 | Gilroy et al. . | |
| 3,324,614 | 2/1965 | Loewwnau . | |
| 3,631,643 | 9/1972 | Jonell et al. . | |
| 3,750,987 | 8/1973 | Gobel . | |
| 3,782,060 | 1/1974 | Gobel . | |
| 4,113,219 | 9/1978 | Mieyal . | |
| 4,258,516 | 3/1981 | Mori et al. . | |
| 4,570,397 | 2/1986 | Creske | 52/126.6 |
| 5,074,085 | 12/1991 | Veda | 52/126.6 |
| 5,079,848 | 1/1992 | Oshiro et al. | 52/105 X |
| 5,265,386 | 11/1993 | Muhlethaler | 52/263 X |

FOREIGN PATENT DOCUMENTS

| | | | |
|---|---|---|---|
| 6710164 | 1/1968 | Netherlands | 52/126.5 |

*Primary Examiner*—Carl D. Friedman
*Assistant Examiner*—Winnie S. Yip
*Attorney, Agent, or Firm*—Howson and Howson

[57] ABSTRACT

A universal slope compensator for use in installing a substantially horizontal surface comprising ballast blocks on a pre-existing surface having a slope, the slope compensator assembly being capable of achieving a wide range of slope compensation.

14 Claims, 5 Drawing Sheets

UNIVERSAL SLOPE COMPENSATOR FOR USE IN CONSTRUCTING A FLAT SURFACE

FIELD OF THE INVENTION

The present invention relates to a slope compensator for use in installing a substantially horizontal surface on a pre-existing surface which slopes relative to the horizontal, and more particularly, the present invention relates to a universal slope compensator capable of accommodating a wide range of slopes.

BACKGROUND OF THE INVENTION

Many buildings have slightly-inclined, so-called flat roof structures that could support a horizontal surface enabling the roof to be used as a patio, deck or the like. Often, the roof surface is sloped at a given angle from the horizontal to drain rainfall and melting snow. In addition, the flat roof tops are generally of a material which is not suitable for walking or standing, and not aesthetically pleasing.

Recent developments in roof paving technology have resulted in the introduction of single-ply protected membrane roof systems which are especially suitable for low slope roofs and decks. They usually include a single-ply water impermeable membrane, with or without thermal insulation layers, held in place and protected from the elements by ballast systems of various types and configurations. Basic systems utilize lightweight rectangular ballast blocks which provide a surface suitable for walking and standing and which provide an aesthetically pleasing appearance.

Due to the slope of the roof surface on the pre-existing structure, apparatus is required for compensating for the slope in order to provide a substantially horizontal deck surface. Prior art slope compensators have either been too simplistic and inaccurate, or too complicated resulting in too much time consumed in installation. Simple wedge devices have been used; however, many different sizes are required since the slope on various buildings will differ. Even on the same roof, there may be varying slopes. More complicated devices provide means for adjusting their heights. These complicated devices require too much time to install and their heights are hard to replicate consistently at all the locations on the roof.

Although various slope compensators of the prior art may function satisfactorily for their intended purposes, there is a need for a universal slope compensator of simple construction which can provide accurate slope compensator for a wide range of slopes. Installation of a satisfactory slope compensator should be easily and quickly performed by workmen possessing a minimum of special skills. Furthermore, a desirable slope compensator should be inexpensive to manufacture in commercial quantities.

OBJECTS OF THE INVENTION

With the foregoing in mind, the primary object of the present invention is to provide a novel slope compensator for use in providing a substantially horizontal surface on a pre-existing sloped surface and having the capability of compensating for a wide range of slopes.

Another object of the present invention is to provide a method for efficiently installing a substantially horizontal surface on a pre-existing roof sloped surface utilizing a universal slope compensator of simple construction.

A further object of the present invention is to provide a universal slope compensator which can be manufactured in commercial quantities at low cost.

A still further object of the present invention is provide an improved slope compensator which can support a series of ballast blocks in a level plane above a sloped roof while providing accurate slope compensation and space between the blocks for drainage purposes.

SUMMARY OF THE INVENTION

More specifically, the present invention provides a slope compensator for use in installing a substantially horizontal surface on a sloped surface,. The slope compensator is designed to nest within a like slope compensator and to be oriented relative thereto in a particular manner related to the slope. A pedestal is designed to rest on the upper slope compensator and to provide support for a series of ballast blocks.

The slope compensator has a top side and a bottom side. The bottom side contacts and rests on the sloped surface. The top side supports either a pedestal or another slope compensator. The top and bottom sides of the slope compensator are at an angle with respect to each other and define a taper. The taper provides the slope compensator with a maximum elevation point and a minimum elevation point. The slope compensator, or two stacked slope compensators, are placed such that its minimum elevation point is toward the high side of the existing sloped surface.

The slope compensator is constructed so that it can stackably receive, or nest with, a second identical slope compensator. For this purpose, a plurality of slope adjustment indicia are provided to properly align two slope compensators when stacked together. A wider range of slopes can be achieved by aligning various ones of the slope adjustment indicia between the two slope compensators.

Alignment indicia are provided on the slope compensator for ease in placement of the slope compensator(s) in proper relation to the direction of slope of the sloped surface and for defining the placement of the corners of adjacent ballast blocks. The alignment indicia are provided by a series of numbers defining lines whereby the desired orientation is obtained by aligning one of the lines in the direction of slope, or alternatively, perpendicular to the direction of slope. The alignment indicia indicates the maximum and minimum elevation points of the slope compensator or the combination comprising two stacked slope compensators. A plurality of alignment indicia are required since the maximum and minimum elevation points of the combination of two stacked slope compensators are a function of the vertical alignment between the two slope compensators.

The slope compensator, or stacked slope compensators, provide a horizontal foundation for supporting a pedestal. The horizontal surface is preferably provided by a plurality of rectangular-shaped ballast blocks supported at their corners on the pedestal. The slope compensator is located underneath the pedestal at the corners of adjacent ballast blocks. The pedestal has a plurality of upwardly extending intersecting flange projections for physically aligning the corners of four adjacent ballast blocks.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
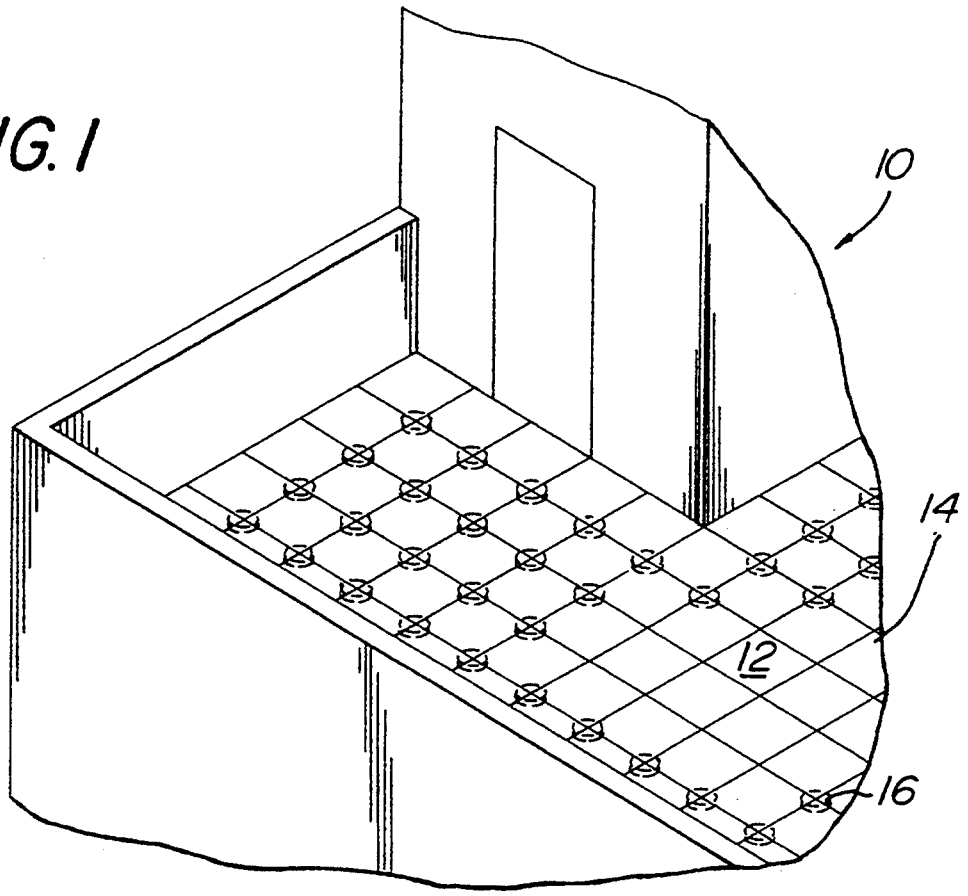
FIG. 1 is a perspective view illustrating a horizontal surface supported by a series of slope compensators embodying the present invention.

Referring now to the drawings, FIG. 1 illustrates a portion of an existing roof structure 10. A series of rectangular ballast blocks 12 are shown installed on the roof structure 10 to provide a substantially horizontal, or level, surface 14. The horizontal surface 14 provides an aesthetic appearance and converts otherwise unusable space into a useful patio or garden.

Figure 4:
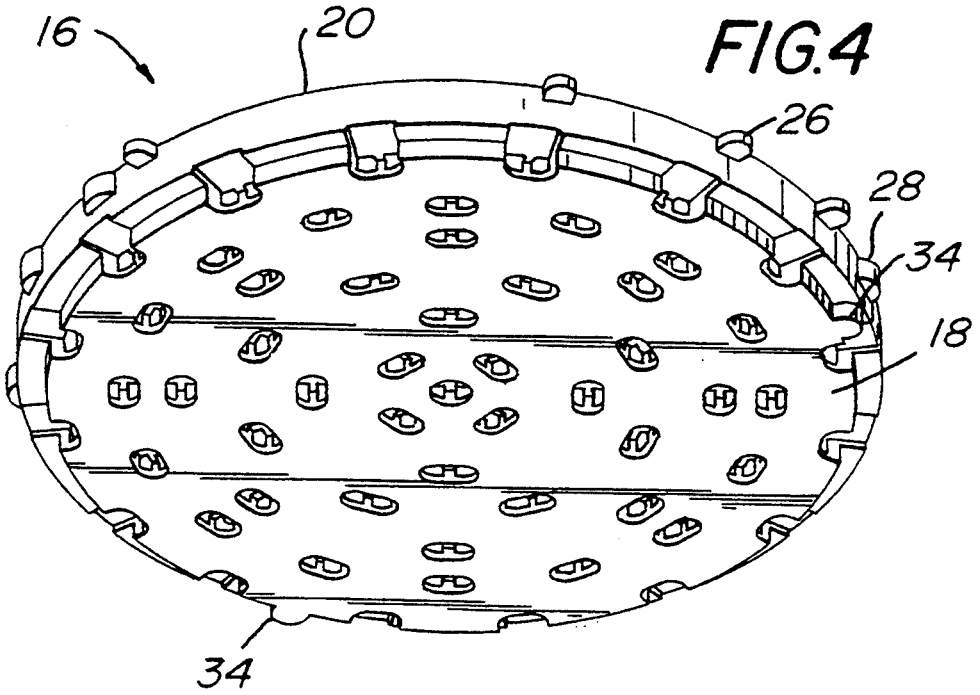
FIG. 4 is a perspective view of the bottom side of a slope compensator embodying the present invention.

In order to compensate for the slope of the pre-existing roof structure 10, the ballast blocks 12 are supported by a series of slope compensators 16 which are shown in dashed lines. As best seen in FIG. 4, a slope compensator 16, has a bottom side 18. The bottom side 18 rests upon and contacts the pre-existing sloped surface 10. The slope compensator 16 has a top side 20 which supports either a pedestal 30, or another identical slope compensator 16. The pedestal 30 supports the substantially horizontal surface 14, which in the illustrated embodiment is comprised of ballast blocks 12.

The slope compensator 16 is designed such that the top and bottom sides, 20 and 18, respectively are at an angle with respect to one another to provide a disc that tapers along a diametrical line. See FIGS. 6 and 7. The taper provides the slope compensator 16 with a maximum elevation point "H" and a minimum elevation point "L". The minimum elevation point is placed toward the high side of the existing sloped surface. The slope compensator of FIG. 7 has a taper which is different from the taper of the slope compensator illustrated in FIG. 6.

Figure 5:
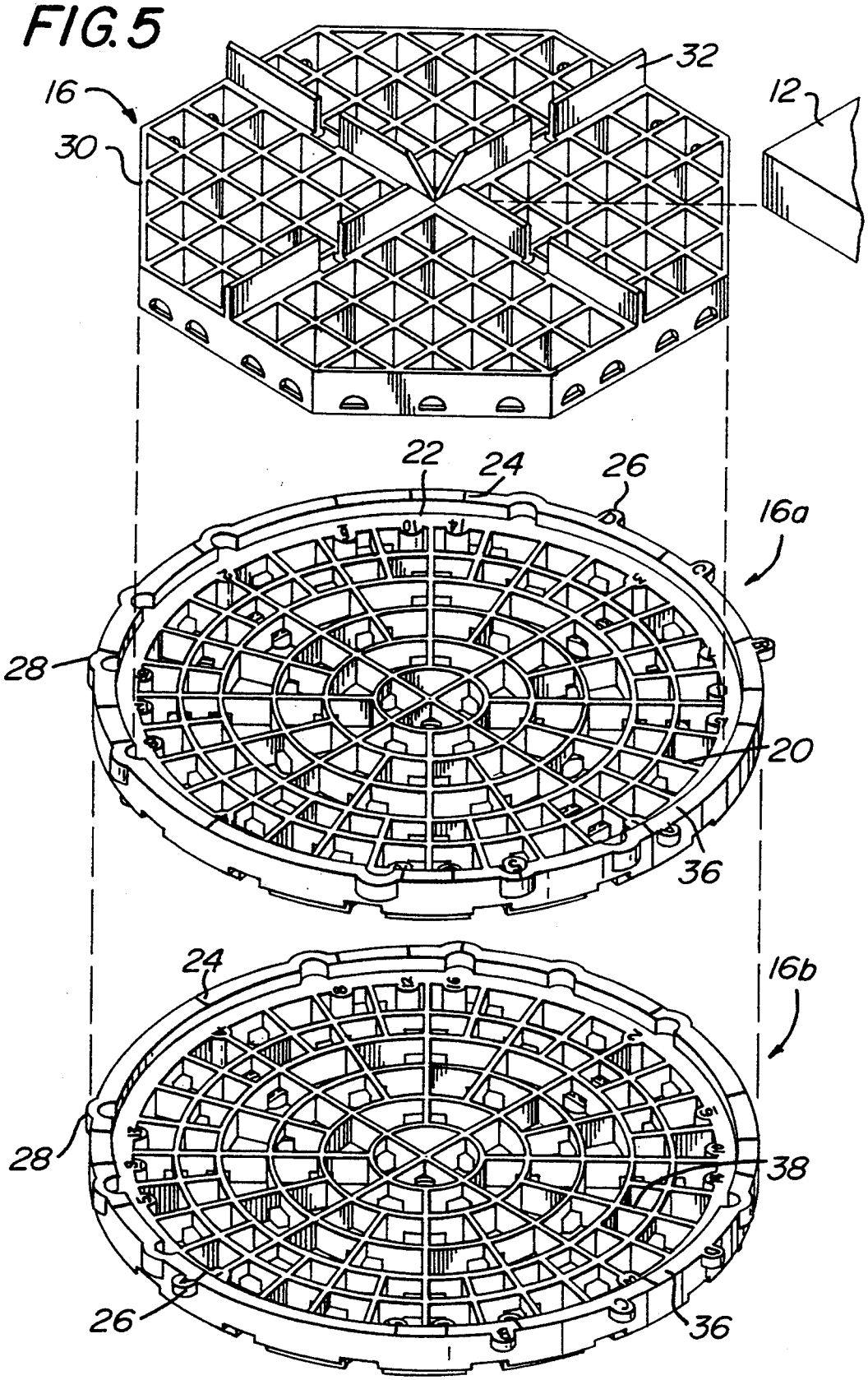
FIG. 5 is an exploded perspective view of two stacked together slope compensators with an overlying pedestal providing upward projections for aligning the corners of four ballast blocks.

In order to accommodate a range of roof slopes, the slope compensator 16 is designed to stackably receive, or nest with, a second identical slope compensator 16. Thus, as shown in FIG. 5, slope compensator **16*a* can be stacked onto slope compensator 16*b*. A wide range of slope compensation can be achieved by rotating the two stacked slope compensators, 16*a* and 16*b***, relative to one another.

To fully appreciate the theoretical underpinnings of the present invention, the function of two stacked, wedge shaped, circular discs and the following geometrical relationship must be understood. Assume that the bottom side of the disc is resting on a horizontal surface and that the diameter of the disc is approximately 100 units. Also assume, that the minimum elevation point on the top side of the disc is equal to 0 units, while the maximum elevation point on the top side of the disc is 1 unit. If a second identical disc is stacked onto the first disc, such that the minimum elevation point of the second disc is located directly above the maximum elevation point of the first disc, the top surface of the combination will be substantially parallel to the bottom surface of the combination. Mathematically, the elevation throughout the combination will equal approximately 1 unit and the angle between the top and bottom surfaces will be 0 degrees. However, as the second disc is rotated relative to the first disc, the angle between the top surface of the combination and the bottom surface of the combination increases, until the second disc is rotated exactly 180 degrees relative to the first disc. The maximum angle, i.e. greatest slope, between the top surface of the combination and the bottom surface of the combination is achieved at the 180 degree mark. This follows, since the minimum elevation points of both the first and second discs are now substantially in vertical alignment, while the maximum elevation points of both discs are also in substantial vertical alignment. Mathematically, the high elevation point of the combination is approximately 2 units, the low elevation point is 0 units, and the slope is equal to 2 units in height every 100 units. Therefore, by altering the rotational relationship between the two stacked discs, a wide range of slopes can be achieved.

While the slope between the top and bottom surfaces of the combination of discs changes, it is important to note that the locations of the minimum elevation point and the maximum elevation point of the combination are also altered. The minimum elevation point of the combination is located at exactly $\frac{1}{2}$ the angle between the minimum elevation points of the two individual discs, where the angle is less than 180 degrees. Conversely, the maximum elevation point of the combination is located 180 degrees from the determined minimum elevation point.

The above mathematical and geometrical concepts are used to enable the present invention to provide a means of compensating for the slope of an existing surface in the installation of a new horizontal surface, thereon. However, the relationship between the two stacked discs must be capable of being achieved quickly, accurately, and consistently by a work person possessing a minimum of special skills. The present invention provides a practical slope compensator whose installation achieves these above stated goals.

Figure 2:
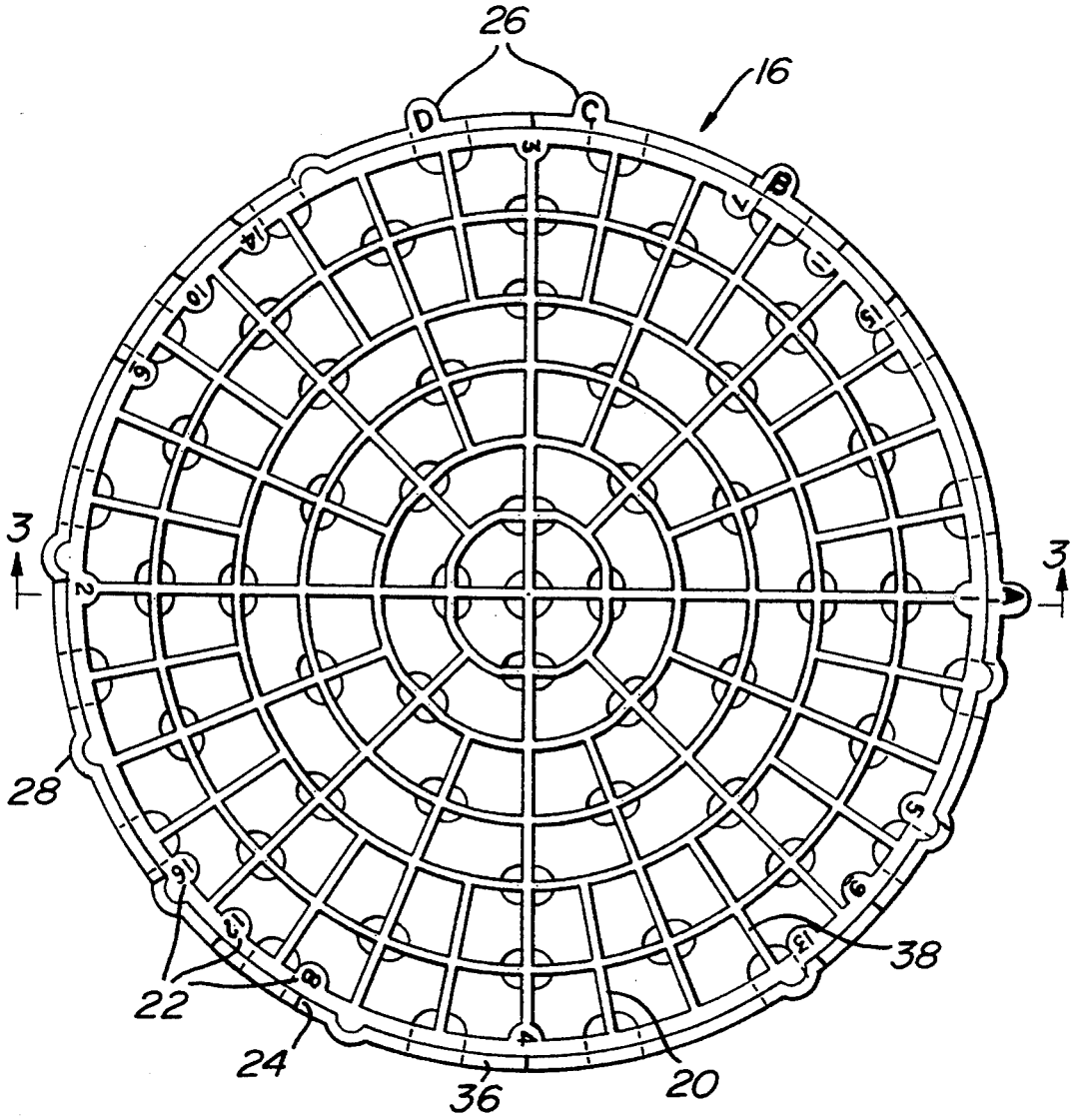
FIG. 2 is a plan view illustrating one of the slope compensators and showing alignment and slope adjustment indicia of the present invention.

To this end, as shown in FIG. 2, the slope compensator 16 has a plurality of slope adjustment indicia 26. The slope adjustment indicia are labeled, for instance, "A", "B", "C" and "D", and help determine the relationship between two stacked slope compensators. For instance, as shown in FIG. 5, by aligning slope adjustment indicia "A" on the top slope compensator **16*a* over adjustment indicia "D" of the bottom slope compensator 16*b*, a specific slope compensation is achieved. Alternatively, if slope adjustment indicia "A" of the top slope compensator 16*a* were located above slope adjustment indicia "A", "B", or "C" of the bottom slope compensator 16*b*** a different slope compensation would be achieved.

According to the present invention, two slope compensators 16 can only be stacked together when the appropriate slope adjustment indicia 26 are aligned. This feature aids in achieving quick, accurate, and consistent installation. For this purpose, the slope compensator 16 has a series of outwardly and upwardly extending, hubs 28, and cooperating projections 34. (See FIG. 4). The projections 34 are located on the bottom side 18 of the slope compensator 16 and matingly engage with hubs 28. If the projections 34 and hubs 28 are not aligned, then the stacking of two slope compensators is prevented. As shown in the drawings, there are two projections 34 and eight hubs 28. This allows for four discrete positions of slope compensator 16*a* on slope compensator 16*b* corresponding to slope adjustment indicia "A", "B", "C", and "D".

The slope compensator 16 has alignment indicia 22 (FIG. 2) which cooperate with the direction of taper to indicate the proper placement of the slope compensator(s) 16 with respect to the direction of slope of the sloped surface 10. In FIG. 2, the alignment indica 22 are illustrated as a series of numbers, "1" through "16". An alignment notch 24 is located next to each numbered ones of the indicia 22 to aid in aligning the slope compensator(s) 16. The alignment indicia 22 define the maximum and minimum elevation points of the various positions of two stacked slope compensators, and a single slope compensator. The sixteen indica numbers define eight diametrical lines, each bisecting the slope compensator 16. For instance, a straight line drawn between alignment indicia "1" and "2" divides the slope compensator 16 into two equal half circles. A straight line drawn between alignment indicia "3" and "4" also divides the slope compensator into two half circles. When a single slope compensator, or two stacked slope compensators with the "A" slope adjustment indicias are aligned, the thickness of the slope compensator 16 is smallest at the location of the numeral "1", and is greatest at the location of the numeral "2". This specific arrangement of lines and taper provides a predetermined slope compensation, for instance, one eighth inch per foot. Note that the line "1-2" and the line "3-4" are perpendicular to one another. Thus, instead of placing the slope compensator 16 on a sloped surface with the line "1-2" aligned with the direction of slope, it could be placed with the line "3-4" perpendicular to the direction of slope. In addition, these lines define the location for placement of the four corners of adjacent ballast blocks in the four quadrants defined by the perpendicular lines.

Three other sets of perpendicular lines are provided by means of appropriate numbered alignment indicia. Each set defines a different slope compensation value and corresponds to slope adjustment indicia "A" of slope compensator 16*a* located over slope adjustment indicia "B", "C", and "D" of slope compensator 16*b*. Therefore, as discussed, a total of five different slope compensation values can be achieved with the slope compensator 16 as shown in the drawings.

Chalk lines can be drawn on the sloped surface 10 in the direction of slope and perpendicular to the direction of slope to aid in locating the placement of the slope compensator. The spacing of the chalk lines are in relation to the size and shape of the rectangular ballast blocks 12 such that the chalk lines define the intersection of adjacent ballast blocks. The slope compensator 16 is located at the intersection of four adjacent ballast blocks for supporting the corner portions of the ballast blocks 12.

Figure 3:
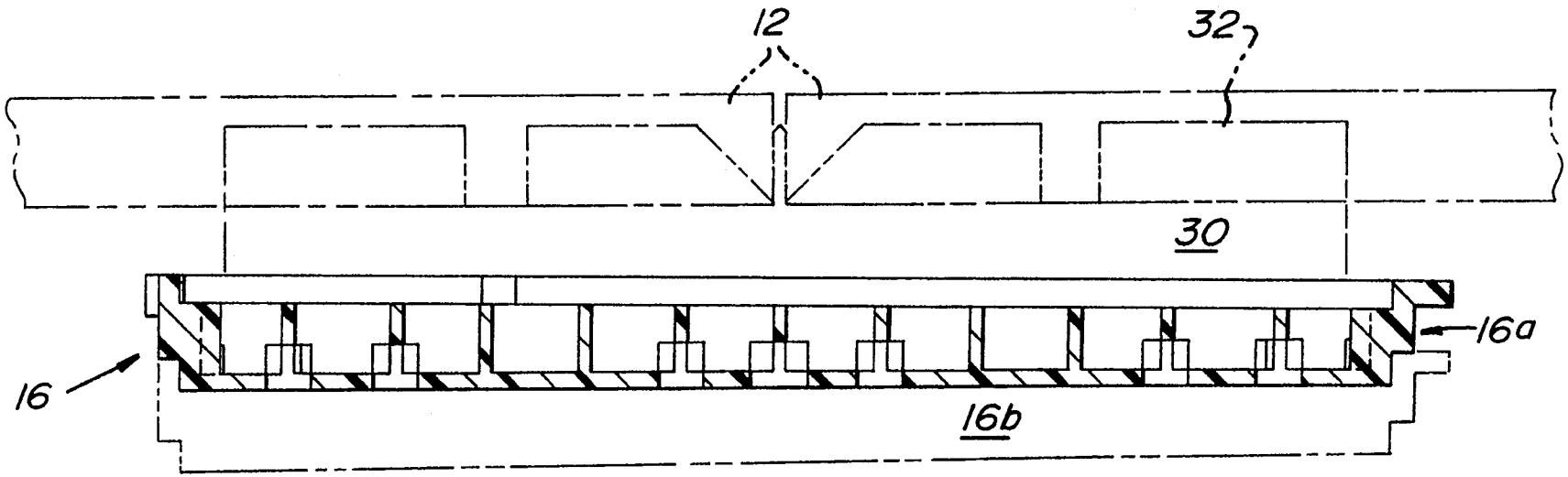
FIG. 3 is cross-sectional view taken along line 3—3 of FIG. 2.

The slope compensator 16 provides a means for physically determining the location of four adjacent ballast blocks 12. To this end, a pedestal 30 provides the slope compensator 16 with a plurality of upwardly extending intersecting projections 32 defining four quadrants. As shown in FIG. 5 the corner of a ballast block 12 is located in one quadrant of the pedestal 30. The ballast blocks 12 rests on the pedestal 30 as illustrated in FIG. 3. The thickness of the pedestal 30 varies to compensate for the needed extra height required by slope compensators located lower on the existing sloped surface.

The slope compensator 16 is capable of supporting heavy loads. To this end, the slope compensator and pedestal are made of high density plastics, and the slope compensator has a structure which is strong yet which uses a minimum of plastics. The slope compensator 16 has an outer peripheral rim 36. The top side 20 has an annular shape which is recessed below the upper edge of rim 36. The bottom side 18 of the slope compensator has a smaller diameter than rim 36 so that multiple, identical slope compensators can be nested and stacked together. The body of the slope compensator 16 has a webbed, grid-like structure 38 with the webs being disposed vertically. In addition, a series of drain holes are provided in the bottom side 18 to permit water drainage.

Figure 6:
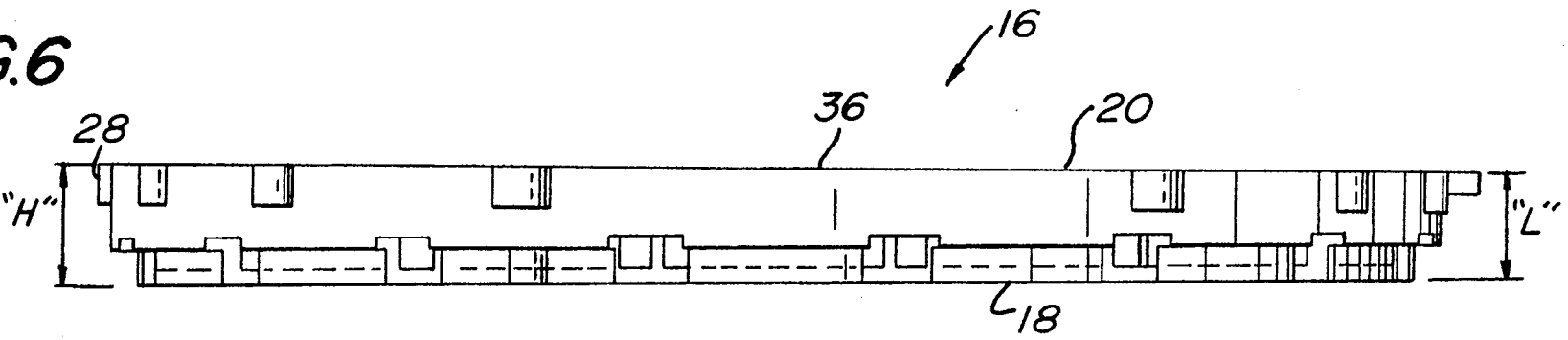
FIG. 6 is a side elevational view of a slope compensator embodying present invention.
Figure 7:
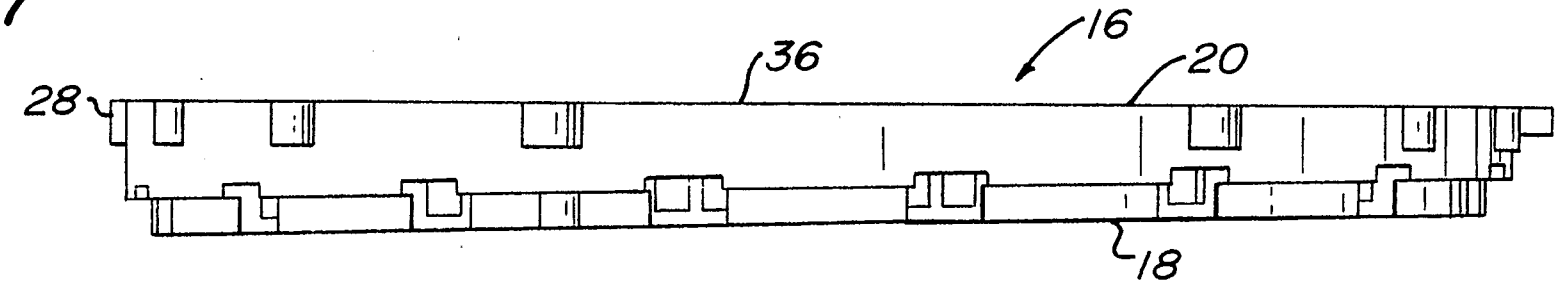
FIG. 7 is a side elevational view of a slope compensator having a taper different from the slope compensator of FIG. 6.

The slope compensator illustrated in FIG. 6 has a taper of $\frac{1}{8}$ inch per foot. The slope compensator illustrated in FIG. 7 has a taper of $\frac{1}{4}$ inch per foot. If desired, slope compensators having different tapers can be color-coded to aid in ensuring proper stacking.

To install a substantially horizontal surface on a preexisting roof structure the direction of slope of the existing roof structure and the extent of the slope is determined. Chalk lines are struck in the direction of the slope and perpendicular to the direction of slope, thereby defining the locations of placement of the slope compensators. The proper alignment indicia on the slope compensator is aligned with the direction of slope, and its associated alignment indicia aligned perpendicular to the direction of slope.

Depending upon the amount of slope compensation required, it may be necessary to stack two slope compensators together. To determine how the slope adjustment indicia should be aligned and which set of alignment indicia should be used, reference is made to Table 1 as set forth below.

TABLE 1

| REQUIRED SLOPE IN/FT | QTY NEEDED | SLOPE ADJUSTMENT INDICIA TOP OVER BOTTOM | ALIGNMENT INDICIA IN LINE/PERPENDICULAR WITH SLOPE | TO SLOPE |
|---|---|---|---|---|
| 1/8 | 1 | | 1-2 | 3-4 |
| 5/32 | 2 | A/B | 5-6 | 7-8 |
| 3/16 | 2 | A/C | 9-10 | 11-12 |
| 7/32 | 2 | A/D | 13-14 | 15-16 |
| 1/4 | 2 | A/A | 1-2 | 3-4 |
| 3/8 | 3 | A/A/A | 1-2 | 3-4 |

TABLE 1-continued

| REQUIRED SLOPE IN/FT | QTY NEEDED | SLOPE ADJUSTMENT INDICIA TOP OVER BOTTOM | ALIGNMENT INDICIA IN LINE/PERPENDICULAR WITH SLOPE | TO SLOPE |
|---|---|---|---|---|
| 1/2 | 4 | A/A/A/A | 1–2 | 3–4 |

The smallest alignment indicia number is always placed toward the high point of slope.

Once the slope compensation is determined, Table 1 can be used to determine whether a single slope compensator can be used, i.e. $\frac{1}{8}$ In/Ft, or whether two, three, or four slope compensators must be stacked together, i.e. 5/32, 3/16, 7/32, $\frac{1}{4}$, $\frac{3}{8}$, or $\frac{1}{2}$ In/Ft. Table 1, also indicates which slope adjustment indicia are to be aligned if two, three, or four slope compensators are to be stacked. Further, Table 1 indicates which alignment indicia should be in line with the slope and which should be perpendicular to the slope. Table 1 also indicates which indicia should be placed toward the highest point of the slope.

A pedestal having upwardly extending projections is placed onto the slope compensator to define the physical relation of four corners of adjacent ballast blocks. Finally, the ballast blocks can be laid onto the pedestals.

In view of the foregoing it should be apparent that an improved slope compensator has been provided for use in converting an otherwise unusable sloped roof surface into a usable deck. The slope compensator is simple to make and use, and enables the support surface to be installed quickly and easily.

While a preferred embodiment of the slope compensator has been described, various modifications, alternations and changes may be made without departing from the spirit and scope of the invention as defined in the appended claims.

I claim:

1. A slope compensator assembly for use in providing a level surface over an inclined supporting surface, comprising:

a first and second slope compensator each having a top surface and a bottom surface, said bottom surface being tapered relative to said top surface, said tapered first and second slope compensators having a point of minimum thickness and a point of maximum thickness;

interengageable means on said first and second slope compensators permitting said bottom surface of one to be stacked onto the top surface of the other in preselected positions of disposition of said minimum and maximum thicknesses; and indicia means on at least one of said slope compensators for enabling the stacked slope compensators to be placed in a predetermined relation with respect to the inclined supporting surface.

2. The slope compensator assembly according to claim 1 wherein each slope compensator has a peripheral rim with an edge, and said top surface being recessed below said edge, and each slope compensator has a bottom peripheral surface shaped to fit within the peripheral rim and to rest upon the top surface of a subjacent nested slope compensator.

3. The slope compensator assembly according to claim 2 wherein said interengageable means are provided on said rim and bottom peripheral surface of each slope compensator for enabling stacking only in selected positions of relative minimum and maximum thickness of the compensators.

4. A slope compensator for use in installing a substantially horizontal surface on a pre-existing structure having a sloped surface with a direction of slope, the slope compensator comprising:

a top side and a bottom side, said bottom side adapted to contact the sloped surface and said top side for creating a horizontal foundation for the horizontal surface, said top and bottom sides being at an angle with respect to each other defining a taper, said taper providing the slope compensator with maximum and minimum elevation points;

wherein the slope compensator is capable of stackably receiving a second identical slope compensator at various angular relations, each angular relation defining a different taper;

an alignment indicia on the slope compensator for aligning placement of the slope compensator in proper relation to the direction of slope of the sloped surface;

whereby the slope compensator can be aligned in various positions relative to said direction of slope to provide a range of slope compensation for use on varying degrees of sloped surfaces.

5. A slope compensator according to claim 4, wherein said horizontal foundation is capable of supporting a plurality of rectangular-shaped ballast blocks for cooperatively forming the horizontal surface.

6. A slope compensator according to claim 5, wherein each of said ballast blocks has corners, and wherein said horizontal foundation is adapted to be located underneath said corners for supporting said ballast blocks.

7. A slope compensator according to claim 6, wherein said alignment indicia are a series of numbers which designate placement of the slope compensator with respect to the direction of slope of the sloped surface and placement of said corners of said ballast blocks.

8. A slope compensator according to claim 7, wherein said alignment indicia indicate said maximum and minimum elevation point of the slope compensator, and wherein said alignment indicia define a series of lines whereby placement of the slope compensator is performed by aligning one of said lines in the direction of slope of the sloped surface and another of said lines perpendicular to said direction of slope of the sloped surface.

9. A slope compensator according to claim 8, wherein the slope compensator has slope adjustment indicia for properly aligning two slope compensators stacked together relative to each other.

10. A slope compensator according to claim 9, wherein the slope compensator is disc-shaped.

11. A slope compensator according to claim 10, further comprising a pedestal being supported by said slope compensator, said pedestal having a plurality of upwardly extending projections which secured in various relations to the slope compensator corresponding to said alignment indicia, for use in physically aligning said corners of said ballast blocks on said slope compensator.

12. A slope compensator assembly for installing a substantially horizontal surface of ballast blocks on a pre-existing structure having a roof surface defining a slope and direction of slope, comprising:

at least one disc having a top side and a bottom side, said bottom side for resting on the roof surface and said top side for providing a horizontal foundation for the horizontal surface;

wherein said top and bottom sides of said disc are at an angle with respect to each other and define a slope compensation;

wherein said disc has a thickness providing a minimum and a maximum height;

wherein said disc is capable of stackably receiving a second identical disc;

a plurality of alignment indicia located on said disc for defining a series of discrete positions for placement of said disc in relation to the roof surface, said placement determining said slope compensation provided by said disc; and a plurality of slope adjustment indicia located on said disc for providing proper relation between stacked discs to achieve a predetermined extent to said slope compensation;

whereby the assembly is capably aligned relative to the direction of slope of the roof surface to provide a range of said slope compensation for various degrees of slope on roof surfaces of pre-existing structures.

13. A slope compensator assembly according to claim 12, further comprising a pedestal capable of engaging said top side of said disc and having upwardly extending projections capable of being aligned with any of said alignment indicia to define the location of said ballast blocks on said disc.

14. A slope compensator according to claim 13 wherein said disc has lateral projections disposed on said bottom side and outwardly extending hubs on said top side, said lateral projections and outwardly extending hubs on two stacked discs cooperating to allow stacking to occur only at discrete locations.

* * * * *